US007244012B2

(12) United States Patent
Yamada et al.

(10) Patent No.: US 7,244,012 B2
(45) Date of Patent: Jul. 17, 2007

(54) HEAD CLEANING DEVICE FOR INK JET PRINTER, AND PRINTER PROVIDED WITH THE SAME

(75) Inventors: Takahiro Yamada, Ibaraki (JP); Shinya Kobayashi, Ibaraki (JP); Takao Matsuoka, Ibaraki (JP); Masuo Furutono, Ibaraki (JP); Michinobu Watahiki, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 310 days.

(21) Appl. No.: 10/975,002

(22) Filed: Oct. 28, 2004

(65) Prior Publication Data

US 2005/0104926 A1 May 19, 2005

(30) Foreign Application Priority Data

Oct. 30, 2003 (JP) ..... P 2003-371283

(51) Int. Cl.
*B41J 2/165* (2006.01)

(52) U.S. Cl. ..... 347/28; 347/29; 347/30; 347/33

(58) Field of Classification Search ..... 347/28, 347/30, 33, 29
See application file for complete search history.

(56) References Cited

U.S. PATENT DOCUMENTS 6,158,838 A * 12/2000 Capurso ..... 347/28
6,168,256 B1 * 1/2001 Sharma et al. ..... 347/28
6,196,657 B1 * 3/2001 Hawkins et al. ..... 347/28
6,682,165 B2 * 1/2004 Yearout ..... 347/28
7,004,560 B2 2/2006 Yamada et al.
2004/0046828 A1 3/2004 Yamada et al.

FOREIGN PATENT DOCUMENTS

| | | |
|---|---|---|
| JP | 8-150710 | 6/1996 |
| JP | 2001-47622 | 2/2001 |
| JP | 2001-260392 | 9/2001 |
| JP | 2002-19132 | 1/2002 |
| JP | 2004-98508 | 4/2004 |

* cited by examiner

*Primary Examiner*—Stephen Meier
*Assistant Examiner*—Ly T. Tran
(74) *Attorney, Agent, or Firm*—McGinn IP Law Group, PLLC

(57) ABSTRACT

A Cleaning fluid discharge openings capable of supplying a cleaning fluid is provided around a suction port mounted in opposition to a nozzle hole. A negative pressure generating source performs suction from the suction port to take out the cleaning fluid from the cleaning fluid discharge openings and to contact the cleaning fluid, thus taken out, with a neighborhood of the nozzle hole, and the cleaning fluid thus contacted is sucked and recovered from the suction port. A member of the suction port is made of a porous resin and the cleaning fluid discharge openings comprise pores formed on a surface of the porous resin. A cleaning fluid supplied to the porous resin is taken out from the pores formed on the surface of the porous resin to clean the neighborhood of the nozzle holes and to simultaneously clean the suction port as a wiping member.

9 Claims, 5 Drawing Sheets

HEAD CLEANING DEVICE FOR INK JET PRINTER, AND PRINTER PROVIDED WITH THE SAME

BACKGROUND OF THE INVENTION

1. Field of the Invention

The present invention relates to an ink jet recording apparatus, and more particular, a recording head cleaning device for high-speed ink jet printers, capable of recording a high grade picture image with high reliability, and a printer provided with the head cleaning device.

2. Description of the Related Art

Line scanning type ink jet printers have been proposed as ink jet printers for printing on a recording medium (for example, a continuous recording paper form, or continuously conveyed cut sheets). This apparatus comprises a lengthy ink jet recording head, on which nozzle holes for discharge of ink drops are arranged in a row, and which are opposed to a widthwise surface (substantially perpendicular to a direction of sheet conveyance) of a continuous recording paper form over an entire width, and selectively controls impact of ink drops, which are discharged from the nozzle holes, on the recording paper surface according to a recording signal. At the same time, main scanning is performed while the recording paper form is moved at high speed in a longitudinal direction of the continuous recording paper form. By virtue of the main scanning and control of impact of ink drops on the recording paper form, formation of recording dots on scanning lines is controlled, thus obtaining a recording picture image on the recording paper form.

As such line scanning type ink jet printers, there have been many of apparatuses making use of a continuous ink jet type recording head as a recording head, and apparatuses making use of an on-demand ink jet type recording head as a recording head. Among these, on-demand ink jet type line-scanning ink jet printers are inferior to continuous ink jet type apparatuses in recording speed but superior thereto in high-definition recording performance and are simple in ink system, so that they are suitable for provision of widespread type high-definition color high-speed printers.

A recording head for such on-demand ink jet type line-scanning ink jet printers comprises a line type one, in which a multiplicity of nozzles are arranged in a row, and a drive voltage is applied to a piezoelectric element, or a heating element to apply pressure to ink in an ink chamber, which are opened at nozzle holes, to discharge ink drops (for example, JP-A-2001-47622).

By the way, the on-demand ink jet type printers need a recording head cleaning device to clean the neighborhood of nozzle holes. This cleaning device serves to remove ink made high in viscosity by virtue of being dried, affected ink, paper dust, etc., adhered to the neighborhood of nozzle holes, thus ensuring stability in discharge of ink.

As conventional recording head cleaning devices, there is known a nozzle cleaning device A to perform a so-called purging action, in which, for example, caps are brought into close contact with all nozzle holes of a recording head to suck ink, and to thereafter perform a so-called wiping action, in which an orifice surface formed with the nozzle holes is wiped off by a wiping member made of rubber or the like. Such cleaning device A involves the following disadvantages.

(1) Since it is necessary to repeat a cleaning action several times in order to remove dust and ink firmly adhered to nozzle holes and their neighborhood, it takes much time and removal is in some cases difficult.

(2) Foreign matters are in some cases pushed into the nozzle holes in the wiping action. Such inconvenience is liable to occur when the wiping member becomes dirty.

(3) Since the multiplicity of nozzle holes are acted by negative press at a time, a sufficient amount of ink cannot flow through the faulty nozzles having a large flow resistance due to plugging of foreign matters or the like.

(4) A large amount of ink is consumed in the purging action.

As a cleaning device to improve the disadvantage (1), a cleaning device B has been proposed, in which a cleaning fluid spray nozzle is provided in the neighborhood of nozzle holes to spray a pressurized cleaning fluid for cleaning in order to remove dust and ink firmly adhered to the nozzle holes and their neighborhood in a short time (for example, JP-A-8-150710).

As a cleaning device to improve the disadvantage (2), a cleaning device C has been proposed, in which a wiping member having been made dirty when wiping off ink adhered to the neighborhood of nozzles is cleaned in a cleaning fluiding tank storing a cleaning fluid to clean the dirt (for example, JP-A-2002-19132).

As a cleaning device to improve the disadvantages (3) and (4), an individual nozzle cleaning device D has been disclosed, in which a suction port is provided to be opposed to a part of nozzle holes among a row of nozzle holes and the suction port is moved along the row of nozzle holes to perform cleaning without direct contact with the nozzle holes (for example, JP-A-2001-260392).

The disadvantages (1) to (4) involved in cleaning devices can be alleviated by combining the cleaning device B and the cleaning device C with the conventional individual nozzle cleaning device D.

However, the cleaning device B involves the following disadvantage.

(5) Spraying of the cleaning fluid in some cases causes entry of the cleaning fluid and bubbles from the nozzle holes to bring about failure in discharge of nozzles. The device is made complex by virtue of disposal of scattered cleaning fluid.

On the other hand, the cleaning device C involves the following disadvantage.

(6) It takes time in moving the wiping member to the cleaning tank to clean the same. In particular, in case of cleaning a line head, the wiping member is liable to become dirty because of cleaning of a multiplicity of nozzles, so that it is necessary to frequently move the wiping member in the course of the purging and wiping actions and it takes time in cleaning, which leads to substantial reduction in recording speed of the printer.

SUMMARY OF THE INVENTION

The present invention has been made to solve the above disadvantages.

According to a first aspect of the invention, a head cleaning device for an ink jet printer, includes: a suction port opposed to nozzle holes; a negative pressure generating source which is connected to the suction port and applies a negative pressure to the nozzle holes and neighborhoods of the nozzle holes; and a cleaning fluid discharging opening which is disposed around the suction port and can discharge a cleaning fluid. The negative pressure generating source performs suction from the suction port to take out the cleaning fluid from the cleaning fluid discharge opening and cause the taken-out cleaning fluid to contact with a surrounding of the nozzle hole to suck and recover the contacted cleaning fluid from the suction port.

According to a second aspect of the invention, an ink jet printer comprising a head cleaning device for an ink jet printer, in which the head cleaning device includes: a suction port opposed to nozzle holes; a negative pressure generating source which is connected to the suction port and applies a negative pressure to the nozzle holes and neighborhoods of the nozzle holes; and a cleaning fluid discharging opening which is disposed around the suction port and can discharge a cleaning fluid. The negative pressure generating source performs suction from the suction port to take out the cleaning fluid from the cleaning fluid discharge opening and cause the taken-out cleaning fluid to contact with a surrounding of the nozzle hole to suck and recover the contacted cleaning fluid from the suction port.

Since the cleaning fluid is taken out from the neighborhood of the suction port to be discharged toward and brought into contact with the nozzle holes and their neighborhood, and thereafter immediately recovered from the suction port together with ink sucked from the suction port, entry of the cleaning fluid and bubbles into the suction port is eliminated and the cleaning fluid is not scattered.

Since the cleaning fluid is sucked from the suction port, which serves also as a wiping member, the cleaning fluid having oozed out cleans the neighborhood of the suction port. Therefore, it is not necessary to frequently move the suction port to a the cleaning fluiding tank disposed in a predetermined position, and there is caused no problem of reduction in speed of a printer, which accompanies a period of time required for cleaning of the wiping member.

Since cleaning of the suction port and individual non-contact purging using the cleaning fluid are possible, the nozzle holes and their neighborhood can be cleaned strongly, and in the case where the ink repellent treatment is applied to the neighborhood of the nozzle holes, dirt of the ink repellent layer can be removed by the cleaning fluid, so that the ink repellent property can be improved and ink drops can be stably discharged, thus enabling realizing a high-speed line type ink jet recording apparatus having a high reliability.

DETAILED DESCRIPTION OF THE PREFERRED EMBODIMENTS

Embodiments of the invention will be described below with reference to the drawings.

[Embodiment 1]

Figures 1A, 1B:
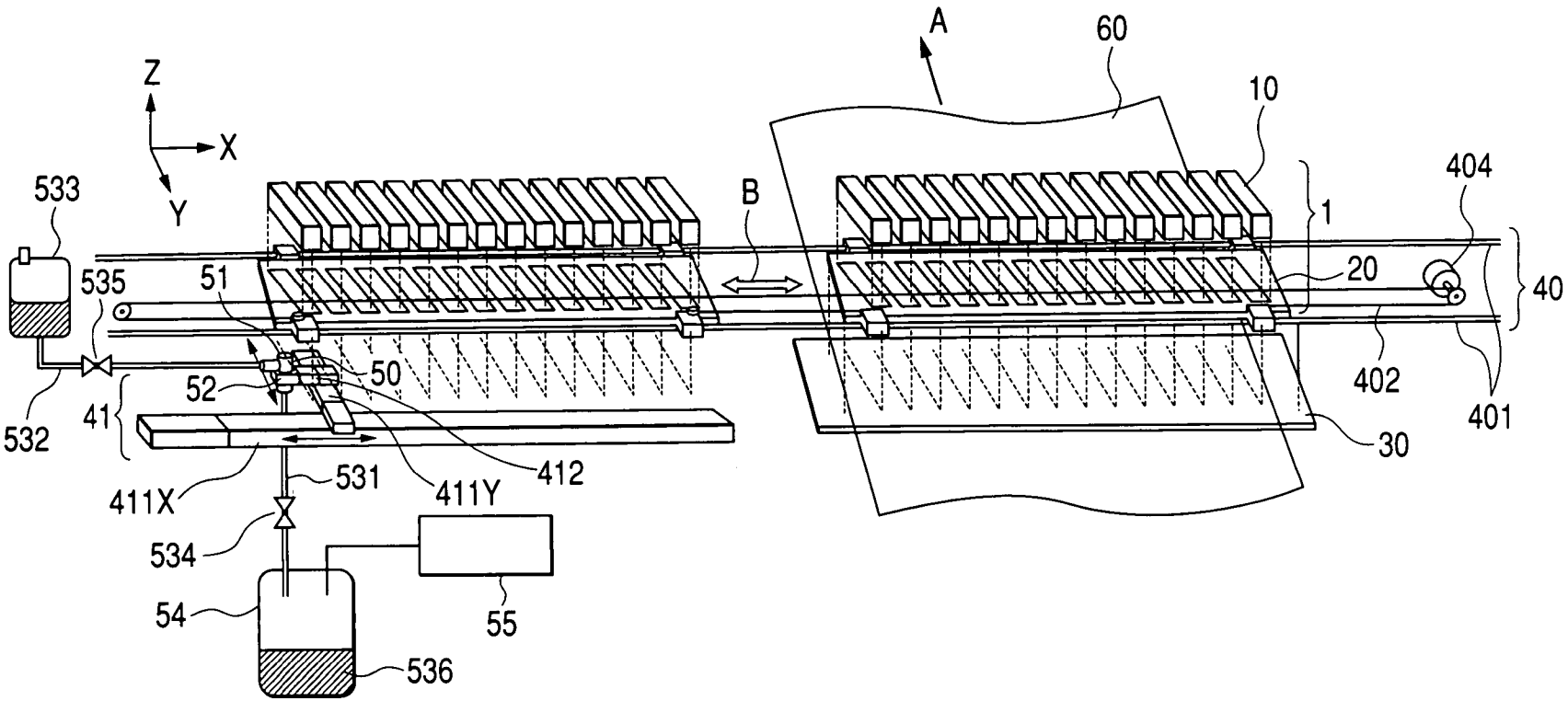
FIGS. 1A and 1B are views showing the construction of an on-demand line type ink jet printer provided with a recording head cleaning device, according to an embodiment of the invention (Embodiment 1).

FIG. 1 shows an embodiment of an on-demand line type ink jet printer provided with a recording head cleaning device, according to the invention. FIG. 1A is a view illustrating a cleaning operation, and FIG. 1B is a view illustrating a recording operation.

Figure 2:
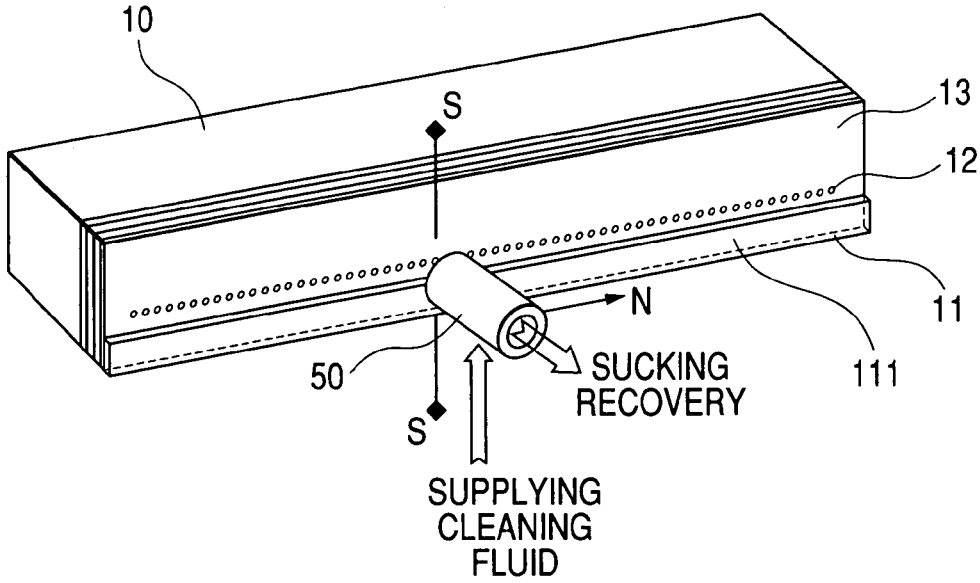
FIG. 2 is a view illustrating the construction and action of a recording head cleaning device according to the embodiment of the invention (Embodiment 1).

FIG. 2 is an enlarged, perspective view showing a recording head module 10 as viewed from a side of nozzle holes.

A recording head being cleaned according to the embodiment comprises a line recording head 1, and respective recording head modules 10 comprises a spacer plate 11 mounted on an orifice plate 13 along a row of nozzle holes 12. A plurality of recording head modules 10 are mounted on a recording head mounter 20 to constitute the line recording head 1. Ink particles discharged from the nozzle holes 12 of the recording head modules 10 according to recording signal input data impact on a recording sheet 60 moving in a direction of an arrow A to be able to perform desired recording. Of course, recording is enabled at the time of conveyance in a reverse direction to the arrow A.

The recording head modules 10 is an on-demand ink jet type linear recording head module comprising n nozzle elements. The respective nozzle elements being opened at n nozzle holes 12 arranged in a row at a predetermined pitch on the orifice plate 13 shown in FIG. 2. Although not shown in the figure, the respective nozzle elements comprise an ink pressurizing chamber opened at the nozzle hole 12, an ink inflow hole to lead ink to the ink pressurizing chamber, and a manifold for supplying ink to the ink inflow hole. Mounted in the ink pressurizing chamber is an actuator, such as PZT piezoelectric element, etc., to vary a volume of the ink pressurizing chamber according to a recording signal. Structures of the respective nozzles are same. An ink particle discharge control signal is fed to the PZT piezoelectric element of the respective nozzle elements, and ink particles are discharged from the respective nozzle holes 12 according to a recording signal.

In order to effect favorable recording in the on-demand line type ink jet printer, it is premised on stable discharge of ink particles. Therefore, the recording head cleaning device according to the invention removes foreign matters, such as affected ink, paper dust, etc., adhered to the nozzle holes 12 of the recording head and their neighborhood and establishes meniscus of fresh ink in the nozzle holes 12.

The recording head cleaning device comprises a recording head evacuating mechanism 40 to move the line recording head from a recording position shown in FIG. 1B to a cleaning position shown in FIG. 1A, a suction tube 50 disposed in the cleaning position, and a suction-tube position setting mechanism 41 mounting a suction port 51 of the suction tube 50 in opposition to and in proximity to the row of nozzle holes 12 and an orifice electrode and ink receiver.

The recording head evacuating mechanism 40 comprises direct-acting rails 401 to move the recording head mounter 20 in a direction of an arrow B, a timing belt 402 to pull the recording head mounter 20 along the direct-acting rails 401, and pulleys revolved by an evacuation drive motor 404, which gives a drive force to the timing belt 402, and meshing with the timing belt 402.

The suction-tube position setting mechanism 41 comprises biaxial moving stages 411X, 411Y, and a suction-port approaching mechanism 412 to move the suction port 51 to a predetermined position toward the orifice plate 13 in a direction of an arrow Z. The suction tube 50 is mounted on the suction-port approaching mechanism by a suction-tube mount 52. The suction tube 50 is connected to a negative pressure generating source 55 through a suction pipe 531 and a recovery tank 54, and connected to a cleaning fluid supply tank 533 through a cleaning fluid supply pipe 532. A suction valve 534 is inserted midway the suction pipe 531 and a cleaning fluid supply valve 535 is inserted midway the cleaning fluid supply pipe 532.

Figure 3:
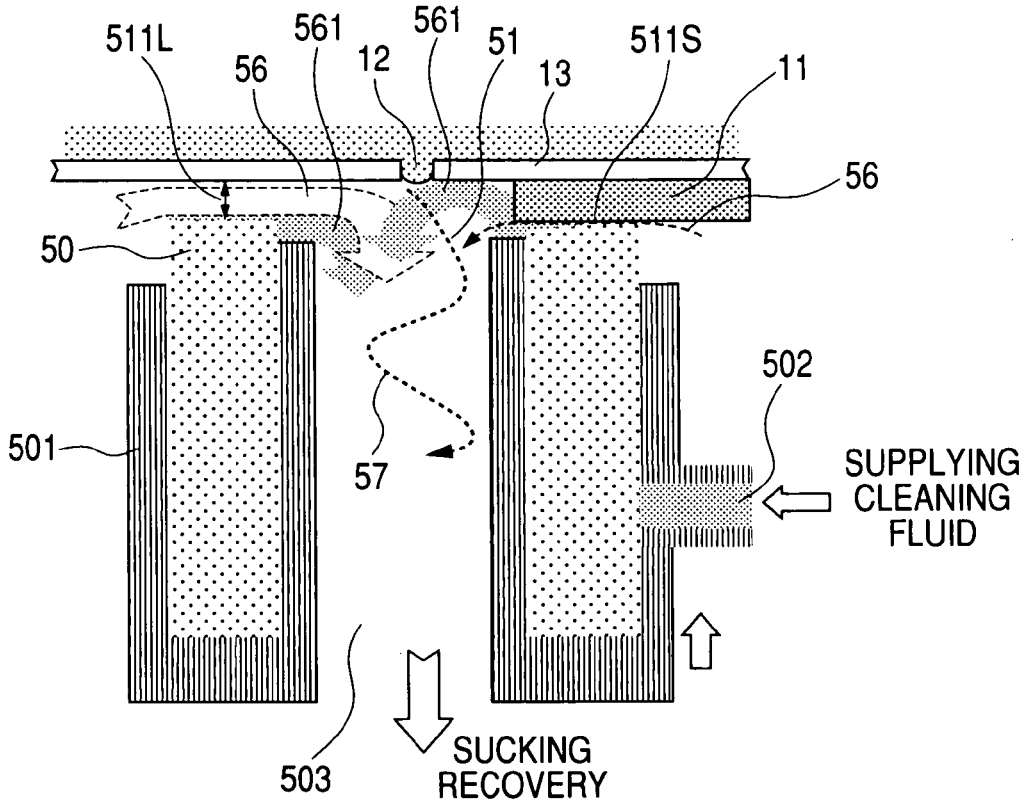
FIG. 3 is a view showing a cross section taken along the line S–S' shown in FIG. 2.

FIG. 3 is a view illustrating the cleaning operation of the cleaning device according to the invention, and showing a cross section, of a neighborhood of the suction tube 50 and the nozzle hole 12, taken along the line S–S' shown in FIG. 2.

In the embodiment, the suction tube 50 adopts a tube comprising a porous resin material and having an outside diameter of 4 mmϕ and an inside diameter of 2.5 mmϕ. The suction tube 50 is pressed to fit into a suction-tube support member 501 to be fixed thereto. The suction-tube support member 501 is shaped to surround the suction tube 50 inside and outside thereof and from a bottom surface thereof and to expose a tip end of the suction tube from the support member, and provided with a cleaning fluid supply opening 502, through which a cleaning fluid is led to the porous resin material from laterally of the suction tube 50.

A porous body, such as ultra high molecular weight polyethylene, in which pores having a pore size of several μm to several tens μm are formed at the rate of several tens %, is usable as the porous resin material. Concretely, a material "Sunmap" (Nitto Denko CO., Ltd.) is usable. With such arrangement, pores, to which the cleaning fluid is led, that is, cleaning fluid discharge openings capable of supplying the cleaning fluid can be made present around the suction port on a surface of an exposed portion at the tip end of the suction tube.

While the suction valve 534 is opened and the suction tube 50 is sucked through a recovery opening 503 by the negative pressure generating source 55, the suction port 51 is positioned by the suction-tube position setting mechanism 41 so as to cover over the row of nozzle holes 12 and the spacer plate 11, and pushed toward the orifice plate 13 (the direction of the arrow Z) by the suction-port approaching mechanism 412. Since the suction port 51 is arranged in this manner, a suction-port clearance 511 is formed to comprise a clearance 511S narrowed by a step defined by the spacer plate 11 on an electrode side and a large clearance 511L on a side of the nozzle hole 12. Thereby, the suction-port clearance 511 can be formed asymmetrical about the row of nozzle holes 12 to set the flow rate and the velocity distribution of an air flow sucked from the suction port asymmetrical relative to a direction perpendicular to the row of nozzle holes 12.

While the negative pressure generating source 55 performs suction, a biaxial moving stage 411 is driven to move the suction tube 50 along the row of nozzle holes 12 in a direction of an arrow N so that a sufficient ink suction pressure of the order of −10 to −20 Pa acts on the nozzle holes 12.

Thereby, since the negative pressure also acts on the tip end of the suction tube around the suction port, the cleaning fluid supplied through the porous body is drawn out from the cleaning fluid discharge openings to make a cleaning fluid flow 561 to be able to strongly clean the nozzle holes 12 and their neighborhood. The cleaning fluid after cleaning is promptly sucked and recovered from the suction port 51 through the recovery opening 503. Owing to such cleaning action, foreign matters, such as paper dust, ink aggregate, etc., adhered to the neighborhood of the nozzle holes 12 and the spacer plate 11 are strongly peeled off to be washed away by the cleaning fluid and the ink to be sucked into the suction tube 50. Such foreign matters are recovered into the recovery tank 54 through the pipe 531. A mixed recovered liquid 536 containing an ink and the cleaning fluid containing foreign matters collected in the recovery tank 54 is discarded.

Since the negative pressure also acts on the nozzle holes 12 opposed to the suction port 51 simultaneously with the cleaning action, ink made high in viscosity by virtue of being dried, bubbles, and fresh ink are sucked through the nozzle holes, so that a purging action is made simultaneously. Accompanying movements along the row of nozzle holes 12 in the direction of the arrow N, the cleaning action and the purging action are sequentially made for the respective nozzles.

On the other hand, simultaneously with suction of the cleaning fluid and the ink, an air is sucked as a sucked air flow 56 from the suction-port clearance 511. Because of a difference in magnitude between the clearances 511L and 511S, the sucked air flow makes differences in flow rate and flow velocity of sucked air therebetween. Thereby, a vortex sucked flow 57, in which the air, the ink, and the cleaning fluid are mixed, is formed in the neighborhood of the suction port. The vortex flow further brings about an increase in detergency.

The ink adhered to the nozzle holes and their neighborhood, and the cleaning fluid are sucked and swept off from the suction port 51 and meniscus of fresh ink is created about the respective nozzle holes after sliding movement of the suction port, so that the wiping action can be made simultaneously.

In this manner, with the cleaning device according to the embodiment of the invention, the action of cleaning the nozzle holes and their neighborhood, the action of purging the ink from the nozzle holes, and the wiping action of removing surplus ink and cleaning fluid from around the nozzle holes can be simultaneously made along the row of nozzle holes and sequentially made for the respective nozzles.

As understood from the above actions, contact of the cleaning fluid with the nozzle holes and drawing-out of the ink from the nozzle holes act simultaneously, so that the cleaning fluid, the cleaned foreign matters, bubbles, and the like are prevented from entering into the nozzle holes. Further, mist of the cleaning fluid, or the like is prevented from scattering to adhere the cleaning fluid and the ink to those portions, such as PZT piezoelectric element, etc. of a recording head, which get into trouble when getting wet.

In the cleaning action, the cleaning fluid outflows from the tip end of the suction tube around the porous suction port under the action of negative pressure due to suction with the pores of the porous suction tube 50 as flow passages to make a cleaning fluid flow 561. At this time, ink made high in viscosity, and foreign matters, which are adhered to the tip end of the porous suction port, are washed away by outward flow of the cleaning fluid from the tip end of the porous suction port and the action of the sucked air flow 56.

As the liquid level of the cleaning fluid in the cleaning fluid supply tank 533 is made higher than a position of the tip end of the suction port, outward flow of the cleaning fluid from the tip end of the porous suction port can be increased in flow rate, so that the tip end of the porous suction port can be enhanced in detergency. In addition, the same effect is produced by providing a pump for pressurization and supplying of the cleaning fluid midway the cleaning fluid supply pipe 532 instead of such way to increase the water head difference of the cleaning fluid in the cleaning fluid supply tank 533.

Further, the tip end of the suction port can be effectively cleaned by performing the following action during a period of time elapsed before the following cleaning is performed after the suction port 51 terminates cleaning of the line recording head 1. The suction valve 534 is closed during a predetermined period of time in the intervals of respective head cleaning actions. Thereby, the cleaning fluid oozing out from the tip end of the porous suction port is not sucked and recovered, so that the cleaning fluid collects at the tip end of the porous suction port. In this state, the cleaning fluid supply valve 535 is again opened. Thus the cleaning fluid having collected at the tip end of the porous suction port is recovered from the suction port at a time. Since the cleaning fluid is momentarily increased in flow rate and a large separation force is applied to ink made high in viscosity, and foreign matters, which are adhered to the tip end of the porous suction port, it is possible to enhance detergency. When opening and closing of the suction valve 534 at predetermined intervals are repeated several times, it is possible to enhance detergency further.

When a porous body, such as ultra high molecular weight polyethylene is used as the porous resin material of the suction tube, frictional resistance accompanying sliding of the suction port is less and wear of the tip end of the suction port is also less. In the case where wear and stain caused by abuse constitute a hindrance in practical use, the construction for replacement of a suction tube may be adopted.

In the case where the ink repellent treatment is applied to surroundings of the nozzle holes, the cleaning device according to the embodiment is effective in removing dirt of the ink repellent layer to revive the ink repellent property. Subsequently, this function and effect will be described.

In order to improve ink drops discharged from the nozzle holes in straight advancing and to decrease dispersion in nozzle characteristics, the ink repellent treatment is in some cases applied to make surroundings of the nozzle holes hard to wet. Concretely, an ink repellent material is formed on a surface of the orifice plate 13 to be a thin film. However, the ink repellent property is in some cases deteriorated since the ink repellent property of a surface of the ink repellent film is deteriorated due to adherence of ink, foreign matters, etc. and the ink repellent film itself contacts with ink.

Liquids effective in removal of dirt and revival of the ink repellent property of the surface of the ink repellent film can be used as the cleaning fluid used in the embodiment of the invention.

Thereby, it is possible to revive the ink repellent property of the ink repellent film to heighten reliability in recording. Even ink, for which an ink repellent film of long service life is hard to form, can be used by virtue of embodying the cleaning device according to the invention.

[Embodiment 2]

Figure 4:
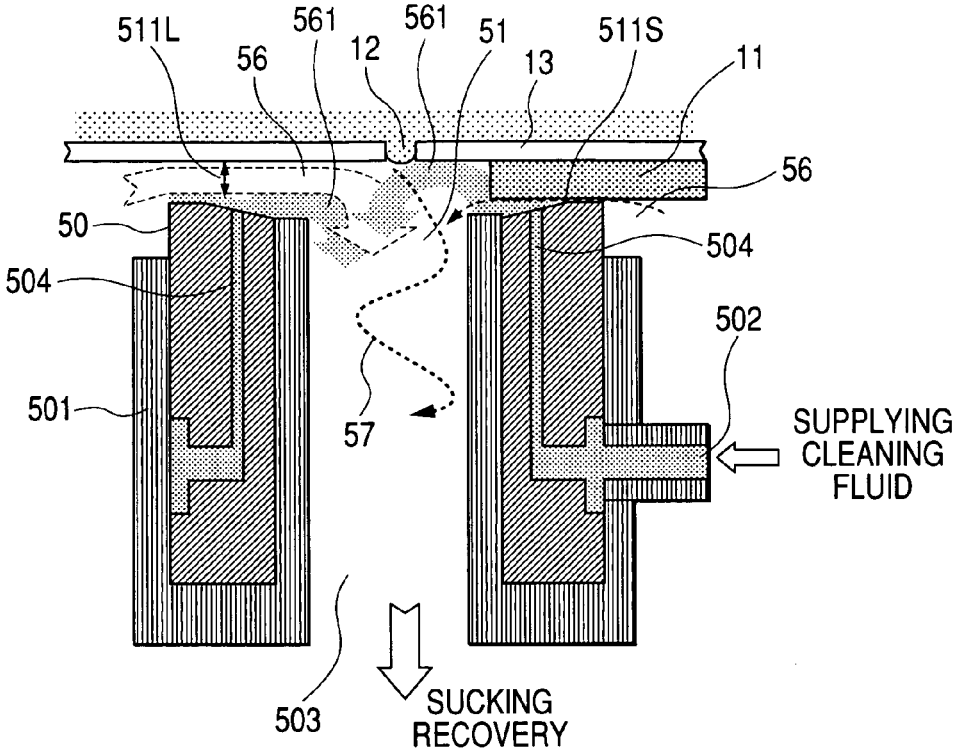
FIG. 4 is a cross sectional view illustrating the construction and action of a recording head cleaning device according to a further embodiment of the invention (Embodiment 2).

FIG. 4 is a view illustrating Embodiment 2 of the invention.

The Embodiment is different in a structure of a suction tube 50 from Embodiment 1. Cleaning fluid discharge flow passages 504 are formed inside a suction-tube wall forming portion to extend in a longitudinal direction of the suction tube. The flow passages 504 are formed in plural at predetermined intervals along the periphery of the suction tube, one ends of the flow passages constituting cleaning fluid discharge openings around the suction port and the other ends being opened to a recess, which is formed on a peripheral side of the suction tube to be ring-shaped. The recess is communicated to the cleaning fluid supply opening.

With such structure, the cleaning fluid supplied from the cleaning fluid supply opening 502 flows through the flow passage in the recess of the suction tube to be delivered to the cleaning fluid discharge flow passages 504 along the periphery of the suction tube to be discharged from the cleaning fluid discharge openings around the suction port. Since the discharged cleaning fluid forms the cleaning fluid flow 561, the cleaning action can be also realized in the Embodiment in the same manner as Embodiment 1.

According to the Embodiment, resins or the like without pores can be used as a material for the suction tube, so that selection of materials is extended in range.

[Embodiment 3]

Figure 5:
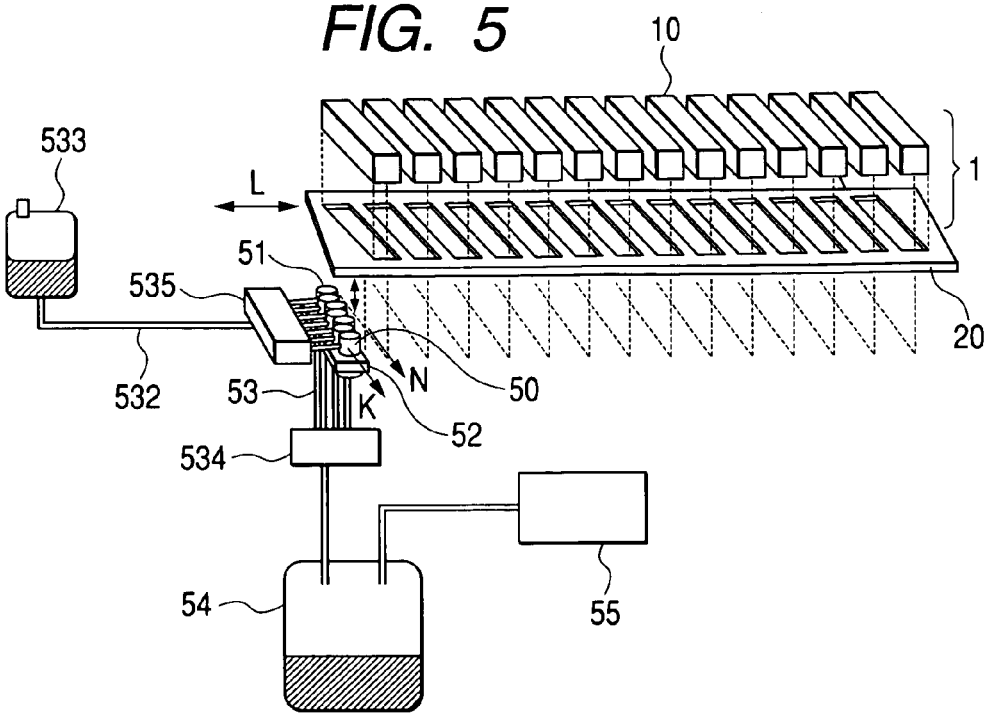
FIG. 5 is a view illustrating the construction of a recording head cleaning device according to a still further embodiment of the invention (Embodiment 3).

FIG. 5 is a view illustrating Embodiment 3 of the invention.

The Embodiment is different from Embodiment 1 in that a plurality of suction ports 51 are aligned successively closely in a zigzag manner in a direction K inclined at a predetermined angle relative to a direction (N direction) of arrangement of nozzle holes so that portions of suction extend continuously without interruption. Suction is applied while the cleaning fluid is supplied sequentially to at least two adjoining suction tubes 50 by two adjoining ones, which define the suction ports 51. A suction valve 534 and a cleaning fluid supply valve 535 can act independently of the individual suction ports, and these valves are controlled to sequentially apply suction to and supply the cleaning fluid to a desired suction tube or tubes. The nozzle holes are sequentially cleaned while the row of suction ports is moved in a longitudinal direction (L direction) of the line recording head.

According to the Embodiment, any mechanism for movement of the suction ports is dispensed with and the line recording head can be quickly cleaned.

[Embodiment 4]

Figure 6:
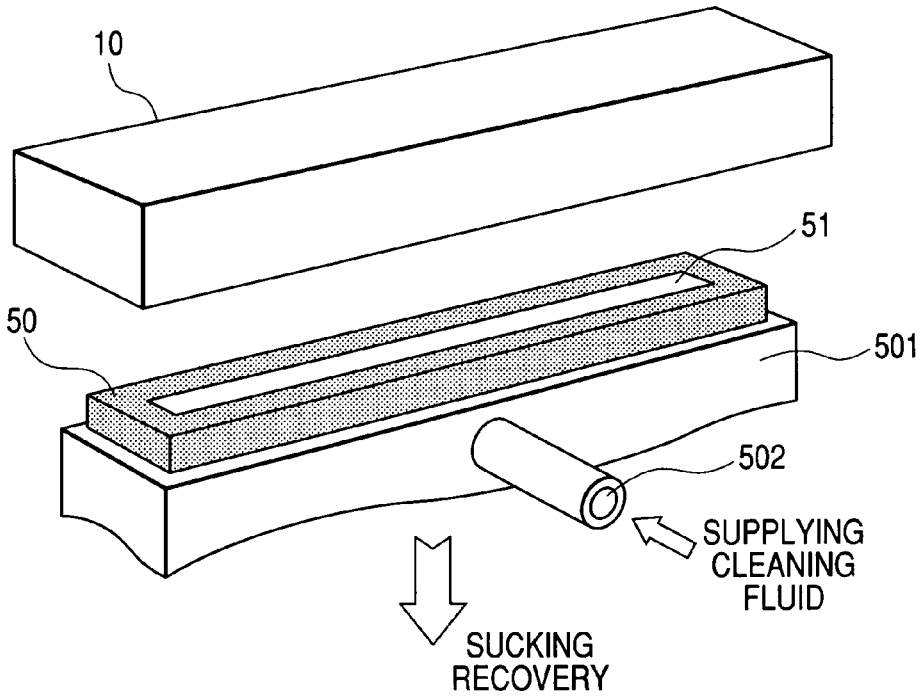
FIG. 6 is a schematic view showing a recording head cleaning device according to a further embodiment of the invention (Embodiment 4).

FIG. 6 is a view illustrating Embodiment 4 of the invention. Although not shown, the spacer plate 11 is mounted on the nozzle surface of the head module 10.

The Embodiment is different from Embodiment 1 in that a suction port 51 of a suction tube 50 is formed to be laterally long in a manner to cover all nozzle holes of a single recording head module 10. While suction is applied to the suction tube 50, which is made of a porous resin material and to which the cleaning fluid is supplied, the suction port 51 is mounted close to the row of nozzle holes of the orifice plate 13. Thereby, the cleaning fluid is taken out from the cleaning fluid discharge openings around the suction port and after the cleaning fluid cleans the neighborhood of the nozzle holes, it is sucked and recovered from the suction port. The cleaning actions described above are sequentially performed for the respective recording head modules of the line recording head.

According to the Embodiment, since all the nozzle holes of a single recording head module 10 can be cleaned at a time, the line recording head can be quickly cleaned. Further, all the nozzle holes of the line recording head can be quickly cleaned by providing that number of suction tubes, which corresponds to the number of recording head modules constituting the line recording head.

Mounting of the spacer plate 11 on the head module 10 may be omitted and the suction tubes 50 may be instead arranged with differences in level. While differences in level are provided in various manners, one (50*a*) of two portions of the suction tubes 50 in parallel to a direction, in which the nozzles are aligned, is different in level from the other of the two portions.

[Embodiment 5]

Figure 7:
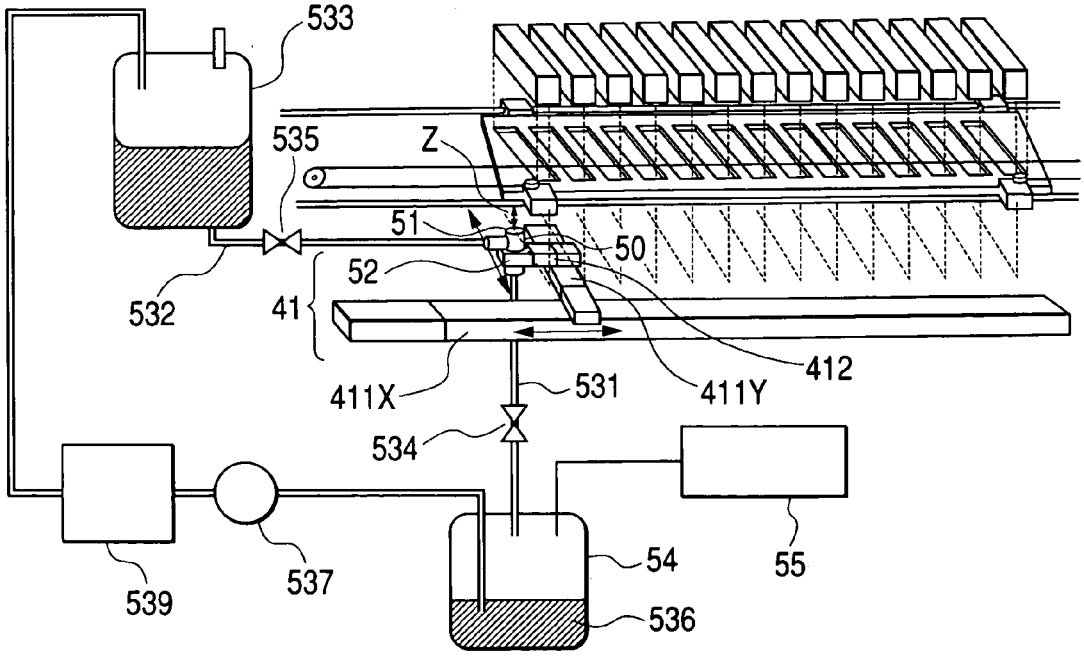
FIG. 7 is a view illustrating the construction of a recording head cleaning device according to a still further embodiment of the invention (Embodiment 5).
Figure 8:
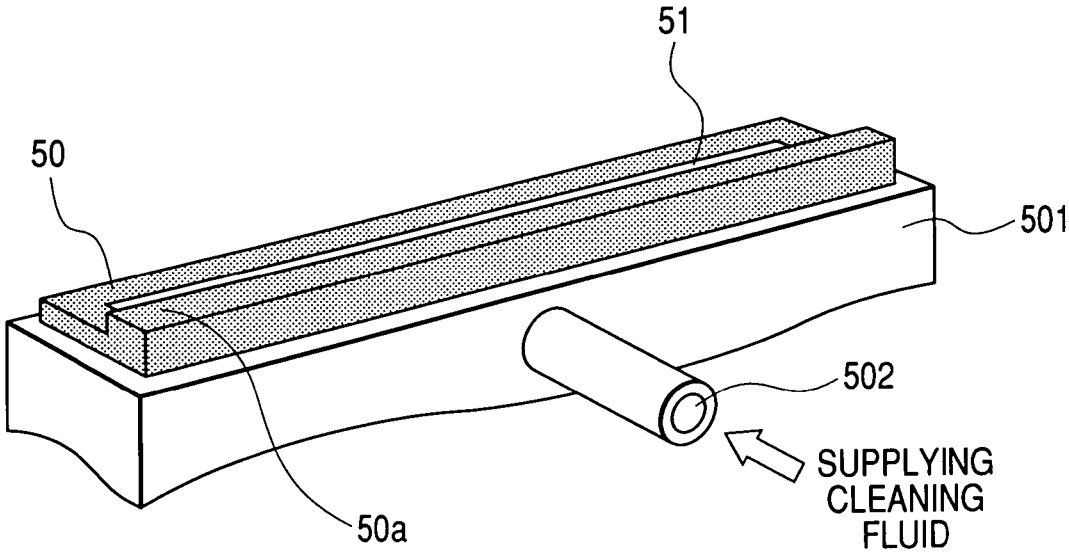
FIG. 8 is a schematic view showing a modification of the recording head cleaning device according to Embodiment 4.

FIG. 7 is a view illustrating a further embodiment of the invention.

The further embodiment is different from Embodiment 1 in treatment of the cleaning fluid and the ink mixed recovered liquid 536, which are recovered into the recovery tank 54 from the suction tube 50. While according to Embodiment 1 the cleaning fluid containing foreign matters collected in the recovery tank 54 and the ink mixed recovered liquid 536 are discarded, they can be reused according to the present embodiment. That is, the recovered liquid 536 is led through a reuse pipe 538 to a cleaning fluid regenerative device 539 by a bailing pump 537. The cleaning fluid regenerative device 539 is provided with a filter, by which foreign matters are removed. The regenerated cleaning fluid is returned to the cleaning fluid supply tank 533 to be again used as a cleaning fluid.

In the head cleaning process, amounts of ink and foreign matters mixed into the wast are small as compared with an amount of the cleaning fluid, so that head cleaning in the present embodiment is not disturbed and so it is possible according to the present embodiment to cut down consumption of the cleaning fluid and to reduce an amount of the recovered liquid 536 being discarded. In the case where the cleaning fluid is decreased in purity as reuse is increased in cycle, a new cleaning fluid supply tank may be provided separately to replenish an unused cleaning fluid. Further, in order to regenerate a cleaning fluid of high purity from the dirty cleaning fluid, the cleaning fluid regenerative device 539 can be provided with a known centrifugal separator, a distillatory, etc., whereby it is possible to markedly enhance the reutilization factor.

While the embodiments of the invention have been described for the case where recording head modules are arranged in the manner shown in FIG. 1, the invention is not limited thereto but can be applied to heads, in which modules are arranged variously. Of course, one module will do.

Since nozzle holes and their neighbourhood can be cleaned to maintain stable discharge of a cleaning fluid for discharge, the invention is not limited to use for printers, in which recording is performed on a recording sheet by means of ink, but applicable also to industrial liquid distributors such as devices for marking products, film forming devices, etc.

What is claimed is:

1. A head cleaning device for an ink jet printer, comprising:

a suction port opposed to nozzle holes;

a negative pressure generating source which is connected to the suction port and applies a negative pressure to the nozzle holes and neighborhoods of the nozzle holes; and a cleaning fluid discharging opening which is disposed around the suction port and can discharge a cleaning fluid, wherein the negative pressure generating source performs suction from the suction port to take out the cleaning fluid from the cleaning fluid discharge opening and cause the taken-out cleaning fluid to contact with surroundings of the nozzle holes to suck and recover the contacted cleaning fluid from the suction port.

2. The head cleaning device according to claim 1, wherein a member of the suction port comprises a porous resin, and the cleaning fluid discharge opening comprises a plurality of pores formed on a surface of the porous resin.

3. The head cleaning device according to claim 1, further comprising a suction pipe comprising a porous resin, wherein the suction port is formed as a tip end of the suction pipe, and the cleaning fluid is supplied from pores of the porous resin on a side of the suction pipe.

4. The head cleaning device according to claim 1, wherein the suction port is disposed out of contact with the nozzle holes, the cleaning fluid is discharged toward the nozzle hole and the neighborhoods of the nozzle holes and an ink is taken out from the nozzle holes simultaneously.

5. The head cleaning device according to claim 4, wherein the suction port abuts against a spacer plate disposed on an orifice plate along a nozzle hole array, to form a clearance between the nozzle hole and the suction port.

6. The head cleaning device according to claim 1, wherein the suction port moves along a nozzle array while being opposed to the nozzle holes, and the negative pressure generating source sequentially applies the negative pressure to the nozzle holes and neighborhoods of the nozzle holes.

7. The head cleaning device according to claims 1, wherein the negative pressure applied to the suction port is decreased or stopped in a period of time except a nozzle cleaning time, to cause the cleaning fluid to ooze out from the cleaning fluid discharge opening, and the negative pressure is succeedingly applied to the suction port to recover the oozed-out cleaning fluid from the suction port.

8. The head cleaning device according to claim 1, wherein a mixed liquid of the cleaning fluid and an ink which are sucked and recovered from the suction port, is used as a cleaning fluid again after removal of a foreign matter in the mixed liquid.

9. An ink jet printer comprising a head cleaning device for an ink jet printer, wherein the head cleaning device comprises: a suction port opposed to nozzle holes;

a negative pressure generating source which is connected to the suction port and applies a negative pressure to the nozzle holes and neighborhoods of the nozzle holes; and a cleaning fluid discharging opening which is disposed around the suction port and can discharge a cleaning fluid, wherein the negative pressure generating source performs suction from the suction port to take out the cleaning fluid from the cleaning fluid discharge opening and cause the taken-out cleaning fluid to contact with surroundings of the nozzle holes to suck and recover the contacted cleaning fluid from the suction port.

* * * * *